US005997807A

United States Patent [19]

Kuboi

[11] Patent Number: 5,997,807

[45] Date of Patent: Dec. 7, 1999

[54] THIN PLATE MADE OF AN FE-NI ALLOY FOR ELECTRONIC PARTS, SHADOW MASK AND CATHODE-RAY TUBE WITH THE SHADOW MASK

[75] Inventor: Takeshi Kuboi, Yasugi, Japan

[73] Assignee: Hitachi Metals, Ltd., Tokyo, Japan

[21] Appl. No.: 08/914,247

[22] Filed: Aug. 19, 1997

[30] Foreign Application Priority Data

Aug. 27, 1996 [JP] Japan ..... 8-225035
Feb. 19, 1997 [JP] Japan ..... 9-050880

[51] Int. Cl.[6] ..... H01F 1/04; H01J 29/07

[52] U.S. Cl. ..... 420/94; 420/459; 420/121; 420/445; 420/452; 313/402

[58] Field of Search ..... 313/402, 403, 313/404, 405, 406, 407; 420/94, 459, 121, 64, 77, 80, 445, 452

[56] References Cited

U.S. PATENT DOCUMENTS 5,562,783 10/1996 Inoue et al. ..... 420/94
5,605,581 2/1997 Inoue et al. ..... 420/94
5,620,535 4/1997 Inoue et al. ..... 420/94
5,628,841 5/1997 Inoue et al. ..... 420/94

FOREIGN PATENT DOCUMENTS 61-201758 9/1986 Japan .
5-171357 7/1993 Japan .
5-49727 7/1993 Japan .
5-209254 8/1993 Japan .
7-48651 2/1995 Japan .

*Primary Examiner*—Ashok Patel
*Attorney, Agent, or Firm*—Sughrue, Mion, Zinn, Macpeak & Seas, PLLC

[57] ABSTRACT

A thin plate made of an Fe—Ni alloy for electronic parts, which has excellent softening property. The alloy consists essentially of, by weight, 32 to 40% Ni, not more than 0.1% Si, not more than 0.5% Mn and 5 to 50 ppm boron, and balance of Fe and unavoidable impurities. It comprises also trace elements which fulfill the following requirements: "S+O"≦150 ppm, Al≦400 ppm, N≦50 ppm, P≦100 ppm, an element of IVa, Va and VIa Groups defined in the periodic table being not more than 2000 ppm in amount, and an atomic ratio of "B(atom. %)/N(atom. %)" being not less than 0.8, preferably more than 1.0. The invention also relates to a shadow mask made of the alloy and a cathode-ray tube comprising the shadow mask.

10 Claims, 1 Drawing Sheet

THIN PLATE MADE OF AN FE-NI ALLOY FOR ELECTRONIC PARTS, SHADOW MASK AND CATHODE-RAY TUBE WITH THE SHADOW MASK

BACKGROUND OF THE INVENTION

The present invention relates to a thin plate made of an Fe—Ni alloy for electronic parts, which can have lower yield strength and lower hardness by annealing heat treatment under conditions of a lower temperature and a shorter time, a shadow mask made from the thin plate, and a cathode-ray tube provided with the shadow mask. Herein, the term softening treatment"means an annealing treatment performed for softening purpose.

The Fe—Ni alloy has excellent thermal expansion property, thus it has been utilized for the shadow mask of the cathode-ray tube for various display devices.

In the case where the shadow mask is made from the Fe—Ni alloy material, for example, a thin Fe—Ni alloy plate having a thickness of not more than 0.3 mm is prepared and subjected to an etching treatment in order to form minute holes through which electron beam passes. Thereafter the etched thin plate is subjected to bending working to provide it a form of the shadow mask. The obtained shadow mask is incorporated in a cathode-ray tube. In order for realizing the cathode-ray tube which can produce a high resolution image, the shadow mask is required to have a shielding effect with high accuracy against electron beam. Therefore the shadow mask material is required to have a good processability with very high accuracy in etching treatment and press forming. In order to obtain such properties of the shadow mask material, there have been proposed various ways such as reducing inclusions, adjusting of crystal grain size and controlling of crystal orientation.

As one of the ways for improving the accuracy in press forming, there was proposed a warm press forming method by JP-B2-5-49727, in which a material being provided with through holes for electron beam by etching is subjected to forming as heated. It is effective to form the material within a warm temperature range for reducing the yield strength and improving the forming accuracy.

Further, there has been a practice of subjecting materials to softening treatment at not lower than about 800° C. previous to the press forming mentioned above or cold rolling. Such softening treatment is effective in fully softening materials to readily carrying out the press working.

But, since it is not preferable economically to perform the softening treatment at a high temperature higher than about 800° C. for a long time, there has been a demand for developing a material which can be softened at a softening temperature as lower as possible in a time as shorter as possible.

JP-A-7-48651 teaches a material which is subjected to such softening treatment and which is improved in the processability of press forming by reducing the amount of oxygen to decrease oxide inclusions. It is effective to reduce oxide inclusions for improving the processability of press forming. However, such processability can not be enough improved by reducing non-metallic inclusions such as oxides. It is also economically disadvantageous to produce a material being reduced in non-metallic inclusions taking account of a huge cost with respect to manufacturing conditions in the refining process and so on.

SUMMARY OF THE INVENTION

The present invention is proposed under such background.

An object of the invention resides in providing a thin plate of an Fe—Ni alloy excellent in softening property, namely which can be softened at a lower temperature in a shorter time as compared with thin plates of conventional Fe—Ni alloys without incurring a higher cost, a shadow mask made from the thin plate of the Fe—Ni alloy of the invention for electronic parts, and a cathode-ray tube having the invention shadow mask.

Under such object, there is provided a thin plate made of an Fe—Ni alloy for electronic parts, which has excellent softening property, wherein:

the Fe—Ni alloy consists essentially of, by weight, 32 to 40% Ni, not more than 0.1% Si, not more than 0.5% Mn and 5 to 50 ppm boron, and balance of Fe and unavoidable impurities, and wherein trace elements as the impurities comprised in the Fe—Ni alloy fulfill the following requirements:

"S+O"≦50ppm, Al≦400 ppm, N≦50 ppm, P≦100 ppm, {an amount or an aggregate amount of not more than 2000 ppm of at least one element selected from IVa, Va and a VIa Groups defined in the periodic table}, and an atomic ratio of "B(atom. %)/N(atom. %)" being not less than 0.8 (where "S" is sulfur, "O" is oxygen, "N" is nitrogen and "B" is boron). Preferably the Fe—Ni alloy comprises "S" and "O" in terms of S≦10 ppm and O≦100 ppm.

The inventor fully studied previously with regard to relationships among softening property, metal structures and chemical compositions of Fe—Ni alloys. As a result, he found that B (boron) is effective in improving the Fe—Ni alloys in softening property, specifically that a specific amount of "B" promotes growth of crystal grains during softening treatment to accelerate softening of the Fe—Ni alloys when trace elements of "S" and "O" in the alloys fulfill the requirements of "S+O"≦150 ppm and Al≦400 ppm.

According to the study, it was found that "N" (nitrogen) should be decreased because the element notably restrains growth of crystal grains and thus cancel the effect of additive "B".

Finally the invention Fe—Ni alloy mentioned above was found, which comprises "B" as much as possible with respect to the composition ratio of "B/N" thereby the alloy can be softened at a low temperature or in a short time.

According to the invention, it is possible to lower the softening temperature or shorten the softening time in softening treatment by reducing an amount of Al, as a deoxidizer, in the Fe—Ni alloy to not more than 200 ppm, more effectively not more than 20 ppm. It is much more effective in lowering the softening temperature or shortening the softening time when performing softening treatment to adjust the ratio of "B(atom. %)/N(atom. %)" to be more than 1.0.

Thus, the shadow mask can be produced from the invention thin plate of the Fe—Ni alloy with high accuracy in etching working and press forming under a low cost. The cathode-ray tube provided with the invention shadow mask can be produced with a high production efficiency, by which a high resolution image can be realized.

DETAILED DESCRIPTION OF THE INVENTION

Figure 1:
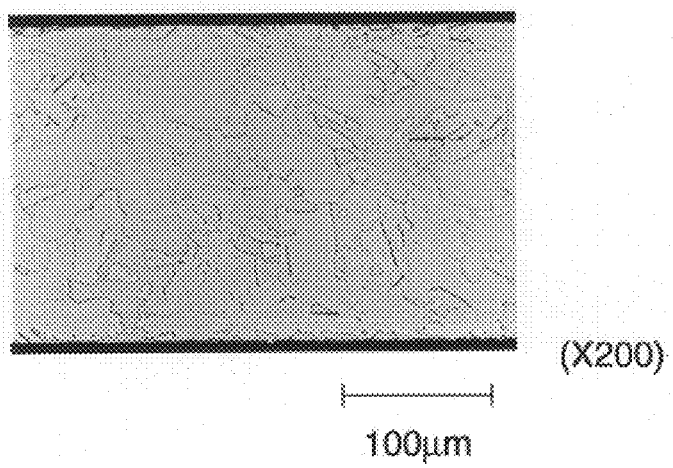
FIG. 1 is a photograph showing a micro-structure of the invention thin plate of the Fe—Ni alloy having the B/N ratio of 2.17 after softening treatment.

As stated above, the invention is based on the finding that B (boron) is effective in improving Fe—Ni alloys in softening property by promoting growth of crystal grains during softening treatment to accelerate softening of the Fe—Ni alloys and that there is an optimum range of chemical composition of the Fe—Ni alloy by which such effect is obtainable.

The Fe—Ni alloys for electronic parts require a growth of crystal grains, which is enough to reduce the yield strength of the alloys, during softening treatment. According to the conventional Fe—Ni alloys, it is necessary to perform a softening treatment at high temperature for a long time.

Thus, the inventor fully studied relationships between a mechanism of growth of crystal grains during softening treatment and chemical compositions of Fe—Ni alloys. Such recognition of the boron effect is based on this study.

According to the invention thin plate of the Fe—Ni alloy comprising boron, since it is possible to readily advance growth of crystal grains during softening treatment, excellent forming properties can be obtained even if the softening treatment is carried out under a lower temperature or a shorter time than that in the prior art.

In order to attain a remarkable boron effect regarding softening property of the Fe—Ni alloy, it is required to control amounts of "N" (nitrogen), "S" (sulfur), "O" (oxygen) and Al in the Fe—Ni alloy. Especially, it should be noted that "N" notably deteriorates the boron effect regarding softening property of the Fe—Ni alloy. It is believed that such phenomenon is due to "a locking effect" of BN (boron nitride) compound which is produced such that boron being concentrated at crystal grain boundaries combines with nitrogen in the case where nitrogen is excess and which will have an unnegligible effect of restraining growth of crystal grains as so called a stopper for such growth. With regard to reasons of deterioration in softening property of the Fe—Ni alloy due to nitrogen, it is also believed that such phenomenon is because boron in the solid solution, which is effective in improving softening property of the Fe—Ni alloy, is decreased due to generation of the compound "BN".

Thus, in the present invention, a total content of nitrogen is restricted to not more than 50 ppm and the ratio of "B(atom. %)/N(atom. %)" is restricted to not less than 0.8 in order to maintain boron free from nitrogen. More preferably, such ratio is restricted to more than 1.0 in order to maintain free boron even if all nitrogen reacts with boron to produce the compound "BN".

Regarding the reason why the Fe—Ni alloy can be improved in softening property under the conditions of not only B(atom. %)/N(atom. %)>1.0 but also B(atom. %)/N (atom. %)≧0.8, it is believed because there would be present dissolved nitrogen in the matrix without combining with boron.

In the present invention, a lower limitation of boron is set to 5 ppm because it was confirmed by an experiment that less than 5 ppm did not notably contribute to improving the softening property. An upper limitation of boron is set 50 ppm because, even if an excess amount of boron, which is over 50 ppm, is added into the Fe—Ni alloy, the effect of softening property is saturated and boron concentrated at grain boundaries deteriorates other properties including etching property.

Herein below, there will be provided a specific description regarding the improving effect of softening property according to the invention with reference to the attached drawings.

Figure 2:
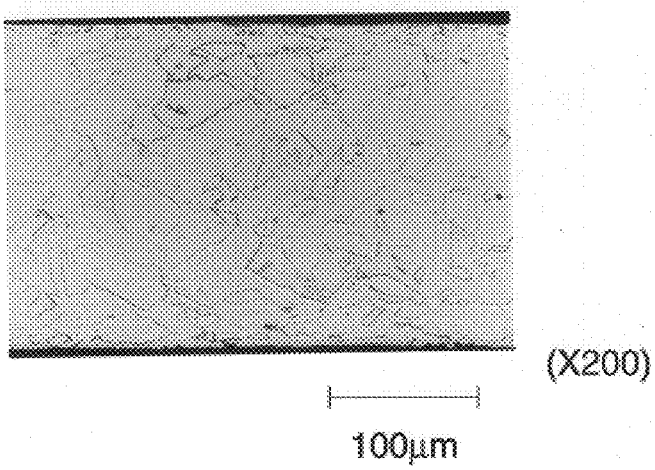
FIG. 2 is a photograph showing a micro-structure of the invention thin plate of the Fe—Ni alloy having the B/N ratio of 1.21 after softening treatment.
Figure 3:
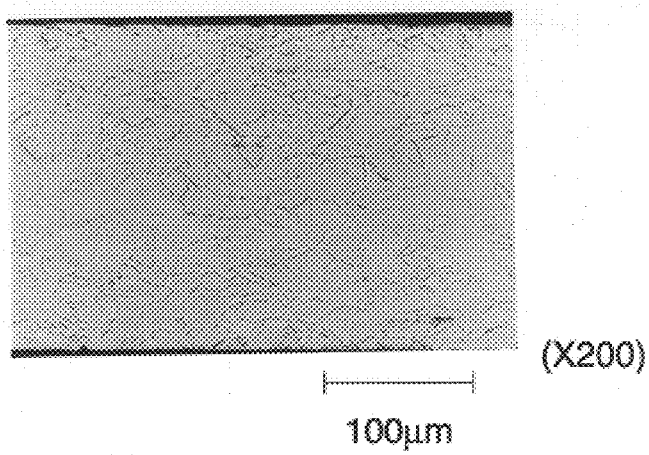
FIG. 3 is a photograph showing a micro-structure of a thin plate of a comparative Fe—Ni alloy having the B/N ratio of 0.72 after softening treatment.

The respective photographs of FIGS. 1 to 3 shows a micro-structure of a thin plate of an Fe—Ni alloy whose average crystal grain size of austenitic structure was previously adjusted to 14 μm and which was subjected to softening treatment at 750° C. for 10 minutes. The micro-structures were observed by an optical microscope at 200 magnifications.

The specimen thin plates of Fe—Ni alloys of FIGS. 1 and 2 had 2.17 and 1.21 of the value B(atom. %)/N(atom. %), respectively, which comply with the requirement of the invention. On the other hand, the other specimen of another Fe—Ni alloy of FIG. 3 had 0.72 of the value B(atom. %)/N(atom. %), which complies with the invention requirements except for the value B/N in atomic percent.

It is noted that all the specimen alloys comprise an adjusted amount of 15 ppm of nitrogen which complies with the invention requirement.

According to the observation of the micro-structures of Fe—Ni alloys after softening treatment shown in FIGS. 1 to 3, the average crystal grain sizes are 18 μm, 17 μm and 14 μm, respectively. It is confirmed that the both specimens of FIGS. 1 and 2 have a notably promoted growth of crystal grains, respectively, as compared with the specimen of FIG. 3 in which there is scarcely present growth of crystal grains. Comparing the both specimens of FIGS. 1 and 2 with each other, the specimen of FIG. 1 has much promoted growth of crystal grains than that of FIG. 2, the former specimen having a higher B/N value in atomic percent. From this, apparently the invention is excellent in improving the Fe—Ni alloy in softening property than the prior art.

Namely, according to the present invention, it is possible to notably improve the Fe—Ni alloy in the softening property as compared with the prior art by controlling the boron content to not less than 0.8 of the value B(atom. %)/N(atom. %) with regard to the Fe—Ni alloy whose nitrogen content is restricted to not more than 50 ppm.

Thus, it is possible for a thin plate of an invention Fe—Ni alloy comprising not less than 10 ppm of nitrogen to achieve an excellent softening property as well as another invention Fe—Ni alloy comprising less than 10 ppm of nitrogen. The invention contributes advantageously also to restraining a modification of production process which brings about a high cost and one example of which is an increase of refining process steps due to reducing nitrogen content.

Now, a description will be provided with regard to S (sulfur), O (oxygen) and Al in the invention Fe—Ni alloy.

S (sulfur) and O (oxygen), which are unavoidable impurity trace elements, combine with a number of unavoidable impurity elements in Fe—Ni alloys to produce inclusions such as MnS or $Al_2O_3$. It is necessary to reduce such inclusions in the Fe—Ni alloy since they restrain growth of crystal grains during softening treatment. From this, S (sulfur) and O (oxygen) are restricted to not more than 150 ppm in total amount.

In general, Al is present in Fe—Ni alloys as a residual deoxidizer element or an inevitable element. It is one of elements which combines with N (nitrogen) and O (oxygen)

to produce inclusions which restrain growth of crystal grains during softening treatment.

The Al content is restricted in the invention Fe—Ni alloy, because aluminum-type inclusions extremely prevent growth of crystal grains, as compared with other type of inclusions, so as to extremely deteriorate softening property of the Fe—Ni alloy. Namely, Al should be restricted to not more than 400 ppm, preferably not more than 200 ppm, more preferably not more than 20 ppm, since a much amount of Al deteriorates the boron effect improving softening property.

On the other hand, the invention thin plate of the Fe—Ni alloy is required to have not only good softening property but also other properties as a material for electronic parts.

Thus, amounts of the following elements should be also controlled.

Ni: This is limited to at least 32% in amount because, in the case of less than 32% Ni, the alloy has a higher thermal expansion rate and thus can not have a property of a low thermal expansion rate material since. The upper limit of Ni is set to 40% because an excess amount of Ni more than 40% deteriorates the alloy in thermal expansion property.

Si: This is present in the Fe—Ni alloy as a residual deoxidizer element or an inevitable element. Si is limited up to 0.1% because an excess amount of Si more than 0.1% increases inclusions in the alloy so as to deteriorate etching property thereof.

Mn: This is present in the Fe—Ni alloy as a residual deoxidizer element or an inevitable element. Mn is limited up to 0.5% because an excess amount of Mn more than 0.5% causes a lot of MnS to precipitate so as to reduce softening rate of the alloy.

P: This is an inevitable impurity in the Fe—Ni alloy. If P (phosphorus) exceeds 100 ppm in amount, growth of crystal grains is delayed a little during softening treatment of the alloy. Such phenomenon would be due to "a drag effect" by phosphorus atom dissolved in the matrix. Thus, P (phosphorus) is limited up to 100 ppm in amount.

Group IVa, Va and VIa elements: The subject elements defined in the Periodic Table, specifically, V, Nb, Ta, Ti, Zr, Hf, Cr, Mo and W, are those of carbide- and nitride-forming. If such elements exceed 2,000 ppm in total amount, there will be arisen "a locking effect" at crystal grain boundaries due to carbides and nitrides so as to restrain growth of crystal grains resulting in that the boron effect of improving softening property of the alloy is prevented. Thus, the total amount of the subject elements are limited up to 2,000 ppm.

The boron effect mentioned above is notably attainable by more strictly controlling the amounts of O (oxygen) and S (sulfur) among the other elements mentioned above.

O (oxygen): Oxygen in the Fe—Ni alloy combines with Al and other elements to produce oxide inclusions so as to restrain the boron effect. Thus, it is preferable to restrict oxygen up to 100 ppm in amount.

S (sulfur): This combines with Mn to produce an inclusion of MnS as stated above. Thus, an excess amount of sulfur produces MnS extremely. An excess amount of precipitated MnS restrains growth of crystal grains so as to extremely delay softening of the alloy, or becomes to initiating points of pitting corrosion leading to uneven etching. Thus, sulfur is limited up to 10 ppm.

As described above, the invention thin plate of the Fe—Ni alloy is excellent in softening property and has good etching property, and thus the shadow mask made from the thin plate can have a high accuracy in press forming while keeping a low cost. Further, the cathode-ray tube provided with the invention shadow mask can be produced with a high production efficiency, by which a high resolution image can be realized.

EXAMPLE

Specimens of the invention and comparative specimens were prepared by the following process steps in order:

a) vacuum-melting of raw materials so that final alloy plates can have the chemical compositions being shown in Table 1, respectively;

c) hot-working the ingots to produce Fe—Ni alloy plates each having 2.5 mm in thickness;

d) pickling the Fe—Ni alloy plates;

e) grinding the surface of the respective Fe—Ni alloy plates;

f) cold-rolling the ground Fe—Ni alloy plates to obtain thiner Fe—Ni alloy plates each having 0.23 mm in thickness;

g) annealing the thiner Fe—Ni alloy plates at a temperature of 850° C.;

h) cold-rolling the annealed Fe—Ni alloy plates to obtain further thiner Fe—Ni alloy plates each having 0.20 mm in thickness; and i) subjecting the Fe—Ni alloy plates to stress relieving annealing treatment at a temperature of 700° C.

TABLE 1

| | | Chemical Composition (mass %) ([C], [S], [P], [B], [N], [O], [S, O], [IVa, Va, VIa]: ppm) | | | | | | | | | | |
|---|---|---|---|---|---|---|---|---|---|---|---|---|
| Group | No. | [C] | Si | Mn | [S] | [P] | Ni | [B] | Al | [N] | [O] | [S, O] |
| A | 1 | 43 | 0.08 | 0.45 | 12 | 94 | 36.2 | 5 | 0.040 | 7 | 102 | 114 |
| | 2 | 48 | 0.09 | 0.49 | 7 | 97 | 36.1 | 5 | 0.038 | 7 | 88 | 95 |
| | 3 | 39 | 0.08 | 0.44 | 6 | 92 | 36.2 | 6 | 0.039 | 8 | 92 | 98 |
| | 4 | 42 | 0.10 | 0.45 | 5 | 85 | 35.9 | 6 | 0.039 | 11 | 88 | 93 |
| B | 5 | 40 | 0.06 | 0.38 | 13 | 89 | 36.0 | 47 | 0.034 | 41 | 85 | 98 |
| | 6 | 45 | 0.08 | 0.38 | 0 | 95 | 35.8 | 48 | 0.35 | 41 | 97 | 103 |
| | 7 | 39 | 0.07 | 0.45 | 6 | 86 | 36.6 | 47 | 0.036 | 45 | 96 | 102 |
| | 8 | 44 | 0.06 | 0.35 | 5 | 93 | 36.4 | 49 | 0.035 | 55 | 87 | 92 |
| C | 9 | 42 | 0.08 | 0.42 | 7 | 94 | 35.7 | 25 | 0.019 | 24 | 85 | 92 |
| | 10 | 45 | 0.09 | 0.41 | 8 | 84 | 36.1 | 20 | 0.018 | 40 | 89 | 97 |
| | 11 | 47 | 0.06 | 0.46 | 6 | 96 | 36.0 | 27 | 0.018 | 51 | 90 | 96 |
| D | 12 | 39 | 0.06 | 0.40 | 9 | 89 | 36.0 | 37 | 0.0015 | 38 | 112 | 121 |
| | 13 | 39 | 0.05 | 0.38 | 5 | 88 | 35.8 | 35 | 0.0016 | 38 | 91 | 96 |

TABLE 1-continued

| | | | | | | | | | | | | |
|---|---|---|---|---|---|---|---|---|---|---|---|---|
| | 14 | 40 | 0.06 | 0.41 | 8 | 89 | 35.9 | 36 | 0.0015 | 52 | 96 | 104 |
| E | 15 | 42 | 0.07 | 0.42 | 9 | 93 | 36.0 | 5 | 0.038 | 5 | 92 | 101 |
| | 16 | 46 | 0.07 | 0.41 | 8 | 91 | 35.9 | 48 | 0.037 | 43 | 94 | 102 |
| F | 17 | 26 | 0.09 | 0.25 | 5 | 54 | 36.1 | 32 | 0.029 | 12 | 21 | 26 |
| | 18 | 31 | 0.07 | 0.26 | 5 | 56 | 36.2 | 26 | 0.029 | 12 | 22 | 27 |
| | 19 | 28 | 0.05 | 0.22 | 4 | 57 | 36.2 | 2 | 0.028 | 13 | 23 | 27 |
| G | 20 | 35 | 0.08 | 0.13 | 6 | 23 | 35.9 | 49 | 0.016 | 22 | 33 | 39 |
| | 21 | 33 | 0.06 | 0.09 | 7 | 22 | 35.8 | 15 | 0.015 | 21 | 33 | 40 |
| | 22 | 33 | 0.07 | 0.11 | 6 | 25 | 36.0 | 5 | 0.015 | 19 | 34 | 40 |
| H | 23 | 10 | 0.04 | 0.35 | 4 | 26 | 36.1 | 42 | 0.0015 | 31 | 15 | 19 |
| | 24 | 12 | 0.03 | 0.35 | 3 | 26 | 36.3 | 37 | 0.0016 | 35 | 16 | 19 |
| | 25 | 9 | 0.03 | 0.34 | 5 | 27 | 36.1 | 25 | 0.0015 | 33 | 14 | 19 |
| I | 26 | 16 | 0.02 | 0.04 | 14 | 71 | 36.5 | 38 | 0.0016 | 36 | 73 | 87 |
| | 27 | 15 | 0.02 | 0.035 | 5 | 61 | 36.4 | 37 | 0.0015 | 35 | 45 | 50 |
| | 28 | 16 | 0.03 | 0.04 | 4 | 65 | 36.5 | 35 | 0.0017 | 33 | 46 | 50 |
| | 29 | 18 | 0.01 | 0.039 | 3 | 70 | 36.3 | 38 | 0.0017 | 34 | 43 | 46 |
| J | 30 | 25 | 0.05 | 0.001 | 5 | 32 | 35.7 | 42 | 0.024 | 21 | 33 | 38 |
| | 31 | 24 | 0.08 | 0.002 | 6 | 33 | 35.8 | 18 | 0.023 | 22 | 33 | 39 |
| | 32 | 28 | 0.04 | 0.001 | 8 | 33 | 35.9 | 10 | 0.024 | 23 | 30 | 38 |
| K | 33 | 32 | 0.08 | 0.001 | 15 | 27 | 35.9 | 31 | 0.009 | 20 | 45 | 60 |
| | 34 | 34 | 0.08 | 0.001 | 8 | 24 | 36.1 | 20 | 0.009 | 15 | 28 | 36 |
| | 35 | 36 | 0.07 | 0.001 | 7 | 26 | 36.2 | 41 | 0.008 | 16 | 25 | 32 |
| L | 36 | 32 | 0.06 | 0.21 | 14 | 51 | 36.1 | 2 | 0.022 | 7 | 23 | 37 |
| | 37 | 33 | 0.05 | 0.26 | 8 | 56 | 36.2 | 2 | 0.026 | 8 | 11 | 19 |
| | 38 | 32 | 0.05 | 0.29 | 7 | 45 | 36.5 | 4 | 0.021 | 6 | 12 | 19 |
| M | 39 | 28 | 0.04 | 0.35 | 18 | 41 | 36.7 | 27 | 0.039 | 17 | 123 | 141 |
| | 40 | 28 | 0.03 | 0.34 | 8 | 40 | 36.9 | 25 | 0.037 | 16 | 86 | 96 |
| N | 41 | 32 | 0.04 | 0.29 | 21 | 32 | 35.9 | 23 | 0.0014 | 19 | 123 | 144 |
| | 42 | 33 | 0.04 | 0.28 | 9 | 34 | 35.8 | 24 | 0.0015 | 19 | 98 | 107 |
| | 43 | 32 | 0.03 | 0.28 | 7 | 32 | 36.0 | 23 | 0.0014 | 18 | 53 | 60 |
| | 44 | 30 | 0.05 | 0.29 | 21 | 31 | 35.9 | 26 | 0.0016 | 17 | 134 | 155 |
| O | 45 | 25 | 0.05 | 0.24 | 4 | 35 | 34.2 | 21 | 0.032 | 12 | 21 | 25 |
| | 46 | 27 | 0.04 | 0.27 | 5 | 36 | 34.1 | 23 | 0.045 | 10 | 25 | 30 |
| P | 47 | 35 | 0.05 | 0.25 | 6 | 35 | 35.1 | 25 | 0.035 | 36 | 35 | 41 |
| | 48 | 35 | 0.06 | 0.26 | 6 | 37 | 35.2 | 24 | 0.015 | 36 | 42 | 48 |
| | 49 | 34 | 0.05 | 0.24 | 6 | 37 | 35.3 | 26 | 0.0013 | 38 | 39 | 45 |

Chemical Composition (mass %) ([C], [S], [P], [B], [N], [O], [S, O], [IVa, Va, VIa]: ppm)

| IVa | | | Va | | | VIa | | | | | |
|---|---|---|---|---|---|---|---|---|---|---|---|
| Ti | Zr | Hf | V | Nb | Ta | Cr | Mo | W | [IVa, Va, VIa] | Fe | Remarks |
| <0.001 | <0.001 | <0.001 | <0.001 | <0.001 | <0.001 | 0.005 | <0.001 | 0.003 | 80 | Bal. | Invention example |
| <0.001 | <0.001 | <0.001 | <0.001 | <0.001 | <0.001 | 0.005 | <0.001 | 0.002 | 70 | Bal. | " |
| <0.001 | <0.001 | <0.001 | <0.001 | <0.001 | <0.001 | 0.006 | <0.001 | 0.003 | 90 | Bal. | " |
| <0.001 | <0.001 | <0.001 | <0.001 | <0.001 | <0.001 | 0.006 | <0.001 | 0.004 | 100 | Bal. | Comparative example |
| <0.001 | <0.001 | <0.001 | <0.001 | <0.001 | <0.001 | 0.005 | <0.001 | 0.004 | 90 | Bal. | Invention example |
| <0.001 | <0.001 | <0.001 | <0.001 | <0.001 | <0.001 | 0.006 | <0.001 | 0.003 | 90 | Bal. | " |
| <0.001 | <0.001 | <0.001 | <0.001 | <0.001 | <0.001 | 0.006 | <0.001 | 0.004 | 100 | Bal. | " |
| <0.001 | <0.001 | <0.001 | <0.001 | <0.001 | <0.001 | 0.004 | <0.001 | 0.005 | 90 | Bal. | Comparative example |
| <0.001 | <0.001 | <0.001 | <0.001 | <0.001 | <0.001 | 0.008 | <0.001 | 0.002 | 100 | Bal. | Invention example |
| <0.001 | <0.001 | <0.001 | <0.001 | <0.001 | <0.001 | 0.006 | <0.001 | 0.004 | 100 | Bal. | " |
| <0.001 | <0.001 | <0.001 | <0.001 | <0.001 | <0.001 | 0.006 | <0.001 | 0.003 | 90 | Bal. | Comparative example |
| 0.001 | <0.001 | <0.001 | <0.001 | 0.001 | <0.001 | 0.006 | 0.001 | 0.005 | 140 | Bal. | Invention example |
| 0.001 | <0.001 | <0.001 | <0.001 | 0.001 | <0.001 | 0.004 | 0.001 | 0.005 | 120 | Bal. | " |
| 0.001 | <0.001 | <0.001 | <0.001 | 0.001 | <0.001 | 0.006 | 0.001 | 0.006 | 150 | Bal. | Comparative example |
| 0.002 | <0.001 | <0.001 | 0.002 | <0.001 | <0.001 | 0.006 | 0.002 | 0.003 | 150 | Bal. | Invention example |
| <0.001 | 0.003 | <0.001 | 0.001 | <0.001 | <0.001 | 0.004 | <0.001 | 0.005 | 130 | Bal. | " |
| <0.001 | 0.002 | 0.001 | <0.001 | <0.001 | 0.001 | 0.006 | 0.002 | 0.006 | 180 | Bal. | " |
| 0.001 | 0.002 | 0.001 | <0.001 | <0.001 | <0.001 | 0.005 | 0.002 | 0.003 | 140 | Bal. | " |
| 0.002 | 0.002 | <0.001 | <0.001 | <0.001 | <0.001 | 0.006 | 0.003 | 0.006 | 190 | Bal. | Comparative example |
| 0.001 | <0.001 | <0.001 | <0.001 | <0.001 | <0.001 | 0.005 | 0.003 | 0.005 | 140 | Bal. | Invention example |
| 0.001 | <0.001 | <0.001 | <0.001 | <0.001 | <0.001 | 0.004 | 0.001 | 0.003 | 90 | Bal. | " |
| 0.002 | <0.001 | <0.001 | <0.001 | <0.001 | <0.001 | 0.005 | <0.001 | 0.003 | 100 | Bal. | Comparative example |
| 0.002 | 0.002 | <0.001 | 0.004 | 0.002 | <0.001 | 0.010 | 0.001 | 0.011 | 320 | Bal. | Invention example |
| 0.003 | 0.002 | <0.001 | 0.004 | 0.002 | <0.001 | 0.012 | 0.002 | 0.009 | 340 | Bal. | " |
| 0.003 | 0.003 | <0.001 | 0.003 | 0.002 | <0.001 | 0.009 | 0.002 | 0.012 | 340 | Bal. | " |
| 0.070 | 0.032 | <0.001 | 0.008 | 0.003 | 0.001 | 0.048 | 0.010 | 0.005 | 1770 | Bal. | Invention example |
| 0.052 | 0.024 | <0.001 | 0.005 | <0.001 | <0.001 | 0.023 | 0.019 | 0.010 | 1330 | Bal. | " |
| 0.067 | 0.021 | <0.001 | 0.056 | 0.002 | 0.001 | 0.057 | 0.009 | 0.001 | 2140 | Bal. | Comparative example |
| 0.036 | 0.035 | 0.002 | 0.032 | 0.046 | 0.006 | 0.062 | 0.045 | 0.006 | 2700 | Bal. | " |
| 0.009 | 0.008 | <0.001 | 0.009 | <0.001 | <0.001 | 0.010 | 0.021 | 0.006 | 630 | Bal. | Invention example |
| 0.009 | 0.008 | <0.001 | 0.009 | <0.001 | <0.001 | 0.011 | 0.022 | 0.006 | 650 | Bal. | " |
| 0.009 | 0.008 | <0.001 | 0.012 | <0.001 | <0.001 | 0.011 | 0.018 | 0.008 | 660 | Bal. | Comparative example |
| 0.048 | 0.023 | <0.001 | 0.057 | 0.043 | <0.001 | 0.076 | 0.078 | <0.001 | 3250 | Bal. | " |
| 0.052 | 0.022 | <0.001 | 0.063 | 0.023 | 0.001 | 0.078 | 0.096 | <0.001 | 3350 | Bal. | " |
| 0.049 | 0.025 | <0.001 | 0.055 | 0.048 | <0.001 | 0.088 | 0.056 | 0.045 | 3660 | Bal. | " |
| <0.001 | <0.001 | <0.001 | <0.001 | <0.001 | <0.001 | 0.005 | <0.001 | 0.005 | 100 | Bal. | " |

TABLE 1-continued

| | | | | | | | | | | | |
|---|---|---|---|---|---|---|---|---|---|---|---|
| <0.001 | <0.001 | <0.001 | <0.001 | <0.001 | <0.001 | 0.006 | <0.001 | 0.003 | 90 | Bal. | " |
| <0.001 | <0.001 | <0.001 | <0.001 | <0.001 | <0.001 | 0.005 | <0.001 | 0.005 | 100 | Bal. | " |
| <0.001 | <0.001 | <0.001 | <0.001 | <0.001 | <0.001 | 0.005 | <0.001 | 0.003 | 80 | Bal. | Invention example |
| <0.001 | <0.001 | <0.001 | <0.001 | <0.001 | <0.001 | 0.004 | <0.001 | 0.005 | 90 | Bal. | " |
| 0.001 | <0.001 | <0.001 | <0.001 | <0.001 | <0.001 | 0.006 | <0.001 | 0.003 | 100 | Bal. | " |
| 0.001 | <0.001 | <0.001 | <0.001 | <0.001 | <0.001 | 0.006 | <0.001 | 0.004 | 110 | Bal. | " |
| 0.001 | <0.001 | <0.001 | <0.001 | <0.001 | <0.001 | 0.005 | <0.001 | 0.003 | 90 | Bal. | " |
| 0.001 | <0.001 | <0.001 | <0.001 | <0.001 | <0.001 | 0.006 | <0.001 | 0.004 | 110 | Bal. | Comparative example |
| 0.012 | 0.052 | <0.001 | 0.032 | 0.012 | <0.001 | 0.028 | 0.012 | 0.009 | 1570 | Bal. | Invention example |
| 0.013 | 0.055 | <0.001 | 0.029 | 0.013 | <0.001 | 0.030 | 0.013 | 0.010 | 1630 | Bal. | Comparative example |
| 0.001 | <0.001 | <0.001 | <0.001 | <0.001 | <0.001 | 0.009 | <0.001 | 0.003 | 130 | Bal. | Invention example |
| 0.002 | <0.001 | <0.001 | <0.001 | <0.001 | <0.001 | 0.009 | <0.001 | 0.004 | 150 | Bal. | " |
| 0.001 | <0.001 | <0.001 | <0.001 | <0.001 | <0.001 | 0.008 | <0.001 | 0.006 | 150 | Bal. | " |

The thus prepared specimens were subjected to softening treatment at a temperature range of from 700° C. to 900° C. in accordance with the way of elevating temperature stepwise within the above temperature range by keeping those for 10 minutes at every temperature stage of a temperature difference of 10° C. Namely, a plurality of specimens were prepared on every same kind material having the same chemical composition shown in Table 1, and they were annealed at different temperatures for 10 minutes which are 700° C., 710° C., . . . 780° C. and 800° C., respectively.

Thereafter, the annealed specimens were subjected to a tensile test at 200° C. of temperature to find the annealing temperature of the specimens whose 0.2% yield strength are not more than 130 N/mm$^2$. The test result is shown in Table 2 (see the column of "Temperature×10 min.").

On the other hand, the other group specimens which have the same chemical compositions as those mentioned above, respectively, were subjected to softening treatment at a temperature of 750° C. for an annealing time range of from 5 to 40 minutes in accordance with the way of different keeping times in stepwise by 5 minutes. Namely, a plurality of specimens were prepared on every same kind material having the same chemical composition shown in Table 1, and they were annealed at 750° C. for different times, respectively, which are 5, 10, . . . 35 and 40 minutes.

Thereafter, the annealed specimens were subjected to a tensile test at 200° C. of temperature to find the annealing time of the specimens whose 0.2% yield strength are not more than 130 N/mm$^2$. The test result is shown in Table 2 (see the column of "Time×750° C.").

With regard to Table 1, it is noted that the shown chemical compositions are those of the thin plates before the softening treatment and that the content values of Group IVa, Va and VIa elements, i.e. V, Nb, Ta, Ti, Zr, Hf, Cr, Mo and W were determined by omitting a fraction of less than 0.001%, i.e. 10 ppm, respectively.

TABLE 2

| | | | Conditions satisfying not more than 130 N/mm$^2$ of yield strength | | |
|---|---|---|---|---|---|
| Group | No. | B [atomic %]/ N [atomic %] | Temperature (° C.) [× 10 mm.] | Time (min.) [× 750° C.] | Remarks |
| A | 1 | 0.93 | 780 | 20 | Invention example |
| | 2 | 0.93 | 770 | 15 | " |
| | 3 | 0.97 | 770 | 15 | " |
| | 4 | 0.71 | 810 | 25 | Comparative example |
| B | 5 | 1.49 | 750 | 10 | Invention example |
| | 6 | 1.52 | 740 | 10 | " |
| | 7 | 1.36 | 740 | 10 | " |
| | 8 | 1.16 | 810 | 25 | Comparative example |
| C | 9 | 1.35 | 730 | 10 | Invention example |
| | 10 | 0.84 | 760 | 15 | " |
| | 11 | 0.69 | 830 | 25 | Comparative example |
| D | 12 | 1.26 | 720 | 10 | Invention example |
| | 13 | 1.20 | 720 | 10 | " |
| | 14 | 0.90 | 820 | 25 | Comparative example |
| E | 15 | 1.30 | 750 | 10 | Invention example |
| | 16 | 1.45 | 750 | 10 | " |
| F | 17 | 3.46 | 750 | 10 | " |
| | 18 | 2.81 | 750 | 10 | " |
| | 19 | 0.20 | 830 | 25 | Comparative example |
| G | 20 | 2.89 | 730 | 10 | Invention example |
| | 21 | 0.93 | 760 | 15 | " |
| | 22 | 0.34 | 840 | 30 | Comparative example |
| H | 23 | 1.76 | 710 | 10 | Invention example |
| | 24 | 1.37 | 710 | 10 | " |
| | 25 | 0.98 | 760 | 15 | " |
| I | 26 | 1.37 | 800 | 20 | Invention example |
| | 27 | 1.37 | 790 | 20 | " |
| | 28 | 1.38 | 820 | 25 | Comparative example |
| | 29 | 1.45 | 830 | 25 | " |

TABLE 2-continued

| Group | No. | B [atomic %]/ N [atomic %] | Conditions satisfying not more than 130 N/mm² of yield strength: Temperature (° C.) [× 10 mm.] | Time (min.) [× 750° C.] | Remarks |
|---|---|---|---|---|---|
| J | 30 | 2.60 | 730 | 10 | Invention example |
| | 31 | 1.06 | 740 | 10 | " |
| | 32 | 0.56 | 830 | 25 | Comparative example |
| K | 33 | 2.01 | 850 | 30 | " |
| | 34 | 1.73 | 840 | 30 | " |
| | 35 | 3.33 | 830 | 25 | " |
| L | 36 | 0.37 | 850 | 30 | Comparative example |
| | 37 | 0.32 | 840 | 30 | " |
| | 38 | 0.87 | 810 | 25 | " |
| M | 39 | 2.06 | 750 | 10 | Invention example |
| | 40 | 2.03 | 740 | 10 | " |
| N | 41 | 1.57 | 750 | 10 | " |
| | 42 | 1.64 | 720 | 10 | " |
| | 43 | 1.66 | 720 | 10 | " |
| | 44 | 1.98 | 810 | 25 | Comparative example |
| O | 45 | 2.27 | 740 | 10 | Invention example |
| | 46 | 2.99 | 810 | 25 | Comparative example |
| P | 47 | 0.90 | 770 | 15 | Invention example |
| | 48 | 0.87 | 760 | 15 | " |
| | 49 | 0.89 | 750 | 10 | " |

As shown in Tables 1 and 2, specimens of Group A which had lower boron contents (about 6 ppm), respectively, were examined on variations of the softening property due to variations of nitrogen amount.

In specimens No. 1 to 3 which had more than 0.8 of the B(atom. %)/N(atom. %) ratio, specimen No. 1 exhibited not more than 130 N/mm$^2$ of 0.2% yield strength by softening treatment performed at 780° C. for ten minutes or at $_{750}$° C. for twenty minutes. Specimens No. 2 and 3, which had lower sulfur and oxygen contents than specimen No. 1, exhibited not more than 130 N/mm$^2$ of 0.2% yield strength by softening treatment performed at 770° C. for ten minutes or at 750° C. for fifteen minutes.

But, specimen No. 4, which had less than 0.8 of the B(atom. %)/N(atom. %) ratio, exhibited not more than 130 N/mm$^2$ of 0.2% yield strength only by a high temperature softening treatment of 810° C. for ten minutes or a long time softening treatment of 750° C. for 25 minutes.

Specimens of Group B which had higher boron contents (about 47 ppm), respectively, were examined on variations of the softening property due to variations of nitrogen amount.

Group B specimens No. 5 to 7 exhibited excellent softening property since the boron content was enough to improve softening property by adjusting the B(atom. %)/N (atom. %) ratio exceeding 1. Especially, specimens No. 6 and 7 exhibited more excellent softening property, which comprised about 6 ppm of sulfur. On the other hand, specimen No. 8 was inferior in softening property, which comprised a much amount of 50 ppm nitrogen which exceeds the nitrogen content range of not more than 50 ppm defined in the invention.

Specimens of Group C which comprised about 0.018% (not more than 200 ppm) of Al and about 26 ppm of boron, were examined on variations of the softening property due to variations of nitrogen amount.

Specimens of Group D which comprised about 0.0015% (not more than 20 ppm) of Al and about 36 ppm of boron, were examined on variations of the softening property due to variations of nitrogen amount.

From the test result of Groups C and D, it can be understood that Group C specimens are improved in softening property and Group D specimens are further improved in the same property as compared with Groups A and B specimens which comprise higher amounts of Al. This teaches that a reduction of Al is effective for promoting the boron effect of improving softening property. On the other hand, although comparative specimens No. 11 and 14 comprised reduced amounts of Al, they were not fully improved in softening property since they comprised nitrogen exceeding the defined nitrogen amount range of the invention.

Specimens of Group E in which No. 15 comprised lower amounts of boron (5 ppm) nitrogen (5 ppm), and No. 16 comprised higher amounts of boron (48 ppm) and nitrogen (43 ppm), were examined with regard to softening property. According to the test result, they have generally the same softening property. From this, it can be understood that, even if the nitrogen amount is higher, the softening property can be ensured by increasing the boron amount corresponding to the nitrogen amount.

Specimens of Group F, all of which comprised a level of about 12 ppm nitrogen, were examined on variations of the softening property due to variations of boron amount.

Specimens of Group G, which comprised a lower amount Al of about 0.015% (not more than 200 ppm) and about 20 ppm nitrogen, were examined on variations of the softening property due to variations of boron amount.

Specimens of Group H, which comprised a further low amount Al of about 0.0015% (not more than 20 ppm) and about 33 ppm nitrogen, were examined on variations of the softening property due to variations of boron amount.

From the test result of Groups F to H, it can be understood that, in the case where the B(atom. %)/N(atom. %) ratio is not less than 0.8, it is possible to improve the Fe—Ni alloy in softening property even if the nitrogen amount is fixed and the boron amount is varied.

Thus, there can be obtained a conclusion that it is possible to improve the softening property of the Fe—Ni alloy whose nitrogen amount is fixed to not less than 10 ppm. This is a great merit in alloy making taking into consideration that it is difficult to reduce the nitrogen content by refining. It was also confirmed that the Fe—Ni alloy is improved in softening property by reducing Al amount.

Specimens of Groups I, J and K, which comprised about 2000 ppm, about 600 ppm and about 3000 ppm of Group IVa, Va and VIa elements, in total respectively, were examined on the softening property. As can be seen from Tables 1 and 2, in the case where the total amount of Group IVa, Va and VIa elements exceeds 2000 ppm which is the upper limit defined in the invention, even if the B(atom. %)/N(atom. %) ratio fully exceeds 1, the softening property is deteriorated. Further, in the case where the total amount of Group IVa, Va and VIa elements was out of the defined range of not more than 2000 ppm and the softening treatment temperature was lower than $_{800}$° C., it was impossible to attain not more than 130 N/mm2 of 0.2% yield strength.

Specimens of Group L, which comprised less than 5 ppm of boron, were examined on the softening property. As can be seen from Tables 1 and 2, the Group L specimens were not fully improved in softening property.

Specimens of Group M, which comprised about 0.038% (not more than 400 ppm) of Al, were examined on variations of the softening property with regard to reduced amounts of sulfur and oxygen.

Specimens of Group N, which comprised about 0.0015% (not more than 20 ppm) of Al, were examined on variations of the softening property with regard to reduced amounts of sulfur and oxygen.

As can be seen from Tables 1 and 2, the test result of the Groups M and N specimens exhibits that, even if the B(atom. %)/N(atom. %) ratio is generally the same, the lower the sulfur or oxygen amount is, the more excellent softening property can be obtained. Although No. 44 specimen had 1.98 of the B(atom. %)/N(atom. %) ratio, it was inferior in softening property. From this, it can be understood that the total amount of "sulfur and oxygen" should be limited up to 150 ppm.

Specimens of Group O, which comprised not more than 400 ppm and more than 400 ppm of Al, respectively, were examined on the softening property.

Specimens of Group P, which has about 0.90 of the B(atom. %)/N(atom. %) ratio, were examined on the softening property with regard to reduced amounts of Al.

As can be seen from Tables 1 and 2, the test result of the Groups O and P specimens exhibits that, the higher the Al amount is, more inferior the softening property is. Although No. 46 specimen had a higher value 2.99 of the B(atom. %)/N(atom. %) ratio, it could not be improved in softening property since it comprised 0.045% (450 ppm) of Al.

From the above, it was confirmed that, according to the invention thin plate of the Fe—Ni alloy for electronic parts, it is possible to perform the softening treatment at a lower temperature or for a shorter time under advanced softening property than those of the prior art. Thus, it is possible to reduce the production cost and provide the thin plate of the Fe—Ni alloy for electronic parts, which is effective in restraining oxidizing during the softening treatment.

The thin plate of the Fe—Ni alloy is also excellent in workability on press forming after the softening treatment since its yield strength can be well reduced by the treatment. Thus the shadow mask made from the thin plate can have a high accuracy in press forming while keeping a low cost. Further, the cathode-ray tube provided with the invention shadow mask can be produced with a high production efficiency, by which a high resolution image can be realized.

As will be apparent from the above, it is possible for the invention thin plate of the Fe—Ni alloy, from which the invention shadow mask is produced, to perform the softening treatment under a lower temperature and/or a shorter time before warm or cold plastic working.

In general, annealing furnaces for softening treatment are of continuous furnaces which have a high production efficiency. Most of such furnaces are of large-size furnaces in order to insure an enough annealing time. The newly developed Fe—Ni alloy can realize reducing of energy for annealing and a cost down, which allows annealing temperature thereof to be lowered or annealing furnaces therefor to become a comparatively small size. It is also noted that the production efficiency can be improved by utilizing such Fe—Ni alloy which can be annealed for a shorter time.

From the above, apparently the present invention has a large economical effect since it is possible to reduce energy required for annealing and an annealing time by the invention alloy. Thus, again saying, the thin plate of the Fe—Ni alloy is also excellent in workability on press forming after the softening treatment since its yield strength can be well reduced by the treatment. The shadow mask made from the thin plate can have a high accuracy in press forming while keeping a low cost. Further, the cathode-ray tube provided with the invention shadow mask can be produced with a high production efficiency, by which a high resolution image can be realized.

As will be apparent from the above, it is possible for the invention thin plate of the Fe—Ni alloy, from which the invention shadow mask is produced, to perform the softening treatment under a lower temperature and/or a shorter time before warm or cold plastic working.

What is claimed is:

1. A thin plate made of an Fe—Ni alloy for electronic parts, which has excellent softening property, wherein:

said Fe—Ni alloy consists essentially of, by weight, 32 to 40% Ni, Si≦0.1%, Mn≦0.5% 5 to 50 ppm B, (S+O)≦150 ppm, Al≦400 ppm, N≦50 ppm, P≦100 ppm, an element of IVa, Va and VIa Groups defined in the periodic table being not more than 2000 ppm in amount, and balance of Fe and unavoidable impurities and wherein an atomic ratio of"B(atom. %)/N(atom. %)" is not less than 0.8.

2. A thin plate made of an Fe—Ni alloy according to claim 1, wherein the amounts of sulfur and oxygen of said trace elements fulfill the requirements of S≦10 ppm and O≦100 ppm.

3. A thin plate made of an Fe—Ni alloy according to claim 1, wherein the amount of Al of said trace element fulfills the requirement of Al≦200 ppm.

4. A thin plate made of an Fe—Ni alloy according to claim 3, wherein the amount of Al fulfills the requirement of Al≦20 ppm.

5. A thin plate made of an Fe—Ni alloy according to claim 1, wherein the atomic ratio of "B(atom. %)/N(atom. %) is more than 1.0.

6. A shadow mask which is made from said thin plate defined in any one of claims 1 to 5.

7. A cathode-ray tube which is provided with said shadow mask defined in claim 6.

8. A thin plate made of an Fe—Ni alloy for electronic parts, which has excellent softening property, wherein:

said Fe—Ni alloy consists essentially of, by weight, 32 to 40% Ni, Si≦0.1%, Mn≦0.5%, 5 to 50 ppm B, S≦10 ppm, O≦100 ppm, Al≦20 ppm, N≦50 ppm, P≦100 ppm, an element of IVa, Va and VIa Groups defined in the periodic table being not more than 2000 ppm in amount, and balance of Fe and unavoidable impurities, and wherein:

an atomic ratio of "B(atom. %)/N(atom. %)" is not less than 0.8.

9. A shadow mask which is made from said thin plate defined in claim 8.

10. A cathode-ray tube which is provided with said shadow mask defined in claim 9.

* * * * *